US010745265B1

(12) United States Patent
Moertl et al.

(10) Patent No.: US 10,745,265 B1
(45) Date of Patent: Aug. 18, 2020

(54) DISPENSER AND HOUSEHOLD COOLING APPLIANCE

(71) Applicant: BSH HAUSGERAETE GMBH, Munich (DE)

(72) Inventors: Florian Moertl, Neu-ulm (DE); Guenter Zuehlke, Stulln (DE); Karl-Friedrich Laible, Langenau (DE); Senol Temizkan, Aalen (DE); Hans Gerd Keller, Giengen (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/400,388

(22) Filed: May 1, 2019

(51) Int. Cl.
*B67D 3/00* (2006.01)
*F25C 5/20* (2018.01)

(52) U.S. Cl.
CPC ..... *B67D 3/0025* (2013.01); *B67D 3/0074* (2013.01); *F25C 5/22* (2018.01)

(58) Field of Classification Search
CPC ..... B67D 3/0025; B67D 3/0074; F25C 5/22
USPC ..... 222/146.6
See application file for complete search history.

(56) References Cited

U.S. PATENT DOCUMENTS 3,572,407 A * 3/1971 Delorme ..... B67D 3/0003 141/362
4,800,935 A * 1/1989 Buchser ..... B67D 1/08 141/362
6,708,741 B1 * 3/2004 Berry ..... B67D 3/0009 141/351
7,340,915 B2 * 3/2008 Kwon ..... F25D 23/02 62/398
8,827,477 B2 * 9/2014 Doering ..... F24C 15/008 362/92
9,581,382 B2 * 2/2017 Yang ..... F25C 5/22
2006/0065006 A1 * 3/2006 Park ..... F25C 5/22 62/344
2011/0072842 A1 * 3/2011 Park ..... F25D 27/00 62/264
2017/0307274 A1 * 10/2017 Laible ..... F25D 23/126

FOREIGN PATENT DOCUMENTS

DE 102014220360 A1 4/2016

* cited by examiner

*Primary Examiner* — Vishal Pancholi
(74) *Attorney, Agent, or Firm* — Laurence A. Greenberg; Werner H. Stemer; Ralph E. Locher

(57) ABSTRACT

A dispenser (5) for dispensing of at least one of ice or liquid and for mounting into a household cooling appliance (1), comprising:
an output niche (6),
at least one of an ice passage (7) or liquid outlet (8),
a switch (9), which activates an output of at least one of ice or liquid out of the dispenser (5), wherein the switch (9) comprises a protrusion (10),
a separate actuation paddle (11) which is attached to the protrusion (10), wherein
the actuation paddle (11) projects into the output niche (6) in order to be pressed by an object held into the output niche (6), and
a releasable and self-locking connection (12) wherein
the actuation paddle (11) and the protrusion (10) are connected by said releasable and self-locking connection (12), wherein the releasable and self-locking connection (12) is a click-stop connection (13).
A household cooling appliance (1) comprising a dispenser (5) for dispensing of at least one of ice or liquid (5).

16 Claims, 10 Drawing Sheets

DISPENSER AND HOUSEHOLD COOLING APPLIANCE

TECHNICAL FIELD

Figure 1:
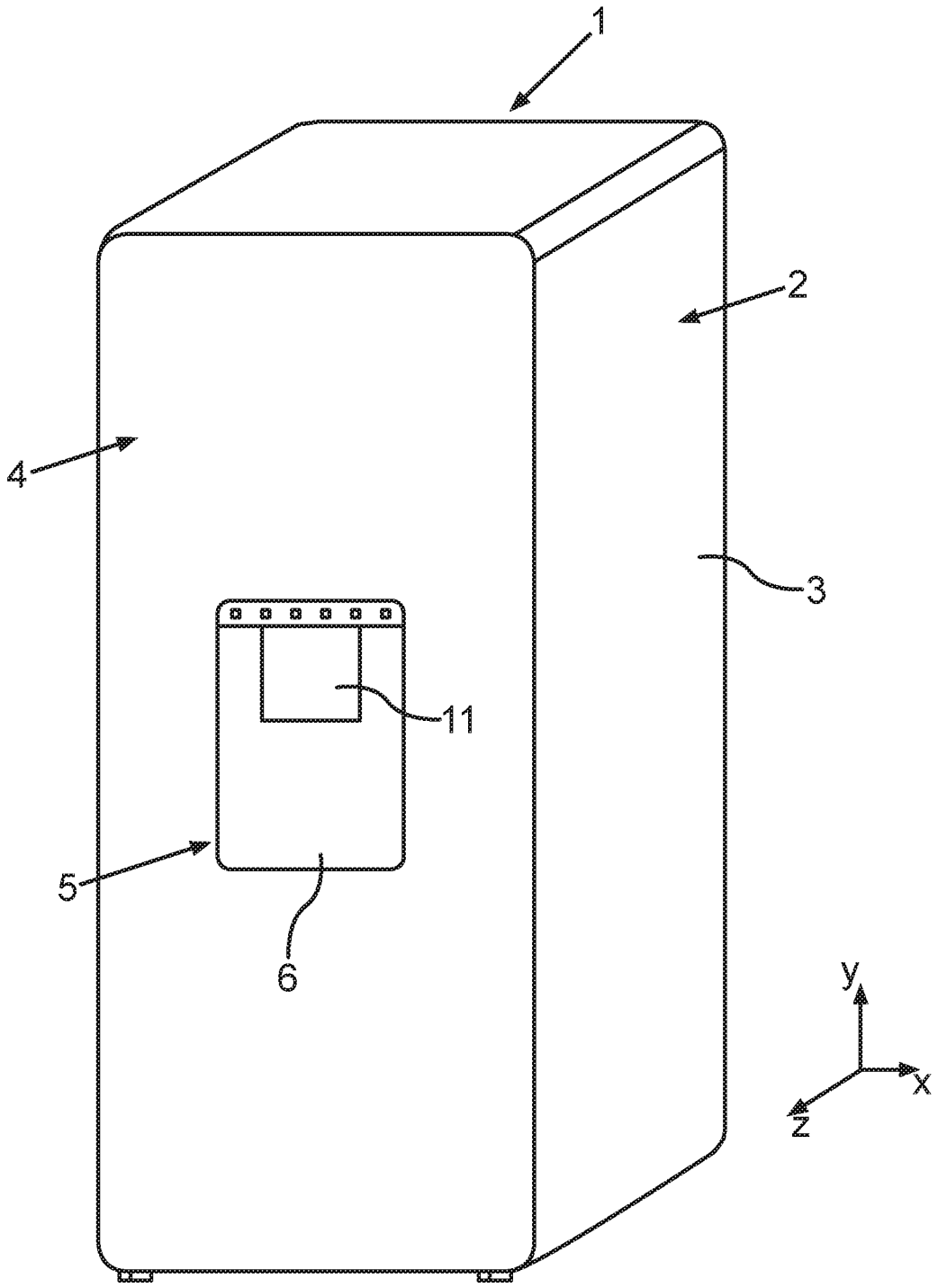

The present disclosure relates to a dispenser for dispensing of at least one of ice or water and for mounting into a household cooling appliance. More particularly, the present disclosure relates to a household cooling appliance with a dispenser for dispensing of at least one of ice or liquid.

BACKGROUND OF THE INVENTION

From the DE 10 2014 220 360 A1 an ice-liquid dispenser is known. This ice-liquid dispenser comprises a protrusion projecting into an output niche. On this protrusion an actuation paddle, which is separate therefrom, is arranged. This actuation paddle on its top edge comprises a slot, into which the protrusion can extend. For connecting between the protrusion and the actuation paddle this actuation paddle is merely slipped upon the protrusion so that this protrusion is inserted into this slot of the actuation paddle.

SUMMARY OF THE INVENTION

It is an object of the invention to provide a dispenser for dispensing of at least one of ice or liquid, in which a mechanical setup of component arranged to be exposed and capable of being acted upon by mechanical forces, is improved.

It is an object of the invention to improve components of the dispenser projecting into an output niche of the dispenser and capable of being mechanically contacted directly by an object or a user.

It is an object of the invention to connect a household cooling appliance with a dispenser for dispending of at least one of ice or liquid in a way that is equally improved in this regard.

The objects are solved by a dispenser and a household cooling appliance according to the independent claims.

According to one aspect, the present disclosure provides a dispenser for dispensing of at least one of ice or liquid for mounting into a household cooling appliance, comprising an output niche, at least one of an ice passage or a liquid outlet. The dispenser further comprises a switch, which activates an output of at least one of ice or liquid out of the dispenser, wherein the switch comprises a protrusion. The dispenser further comprises a separate actuation paddle which is attached to the protrusion, wherein the actuation paddle projects into the output niche in order to be pressed by an object held into the output niche. Further the dispenser comprises a releasable and self-locking connection wherein the actuation paddle and the protrusion are connected by said releasable and self-locking connection, wherein the releasable and self-locking connection is a click-stop connection.

According to one aspect, the present disclosure provides a household cooling appliance with a dispenser for dispensing of at least one of ice or water, wherein the dispenser comprises an output niche, at least one of an ice passage or a liquid outlet. The dispenser further comprises a switch, which activates an output of at least one of ice or liquid out of the dispenser, wherein the switch comprises a protrusion. The dispenser further comprises a separate actuation paddle which is attached to the protrusion, wherein the actuation paddle projects into the output niche in order to be pressed by an object held into the output niche. Further, the dispenser comprises a releasable and self-locking connection wherein the actuation paddle and the protrusion are connected by said releasable and self-locking connection, wherein the releasable and self-locking connection is a click-stop connection.

The formulation "a dispenser for dispensing of at least one of ice or liquid" of the present disclosure means that the dispenser can be configured to dispense ice alone, liquid alone, or ice and liquid.

The formulation "at least one of an ice passage or a liquid outlet" of the present disclosure means that the dispenser can be configured to have an ice passage alone, a liquid outlet alone, or ice passage and liquid outlet.

The formulation "a switch, which activates an output of at least one of ice or liquid out of the dispenser" of the present disclosure means that the switch can be configured to activate an output of ice alone, liquid alone, or ice and liquid.

Another aspects of the present disclosure are disclosed in the dependent claims.

According to another aspect of the present disclosure, the click-stop connection could be a snap-fit-connection.

According to another aspect of the present disclosure, the click-stop connection comprises at least one click-stop part and the protrusion comprises at least one protrusion wall, wherein the click-stop part is integrally formed with the protrusion wall and is resiliently arranged on the protrusion wall.

According to another aspect of the present disclosure, the click-stop part comprises a base plate extending with its surface shape in the plane of the protrusion wall and is resiliently arranged on the protrusion wall.

According to another aspect of the present disclosure, the click-stop part comprises a click-stop nose, and the click-stop nose is integrally formed with the base plate, wherein the click-stop nose is configured for click-stop engagement with a counter click-stop part configured on the actuation paddle.

According to another aspect of the present disclosure, the click-stop nose has a free end and the free end is configured to be tapered.

According to another aspect of the present disclosure, the tapering comprises at least two inclined walls, which are tapered to each other.

According to another aspect of the present disclosure, the base plate has a longitudinal axis extending in the plane of the base plate and through a linkage point of the base plate to the protrusion wall, wherein the longitudinal axis is orientated at an angle of between 30° and 70°, in particular between 30° and 60°, relative to a linear coupling direction, in which the actuation paddle is coupled to the protrusion.

According to another aspect of the present disclosure, the protrusion comprises a receiving shaft bounded by protrusion walls of the protrusion, wherein the actuation paddle comprises a coupling bar, and wherein the actuation paddle is introduced with said, especially lug-like or tongue-like, coupling bar into the receiving shaft in the clicked-in end state of the actuation paddle with the protrusion.

According to another aspect of the present disclosure, the actuation paddle comprises a coupling bar, in which a counter click-stop part is integrally formed, which is configured for click-stop engagement with a click-stop part formed on the protrusion.

According to another aspect of the present disclosure, the click-stop connection comprises at least two click-stop parts and at least two counter click-stop parts for click-stop engagement of the actuation paddle with the protrusion.

According to another aspect of the present disclosure, the dispenser comprises an acoustic signaling device, by which the click-stopped state can be acoustically signaled.

According to another aspect of the present disclosure, the acoustic signaling device comprises an elastic rib, which is elastically preloaded when coupling between the actuation paddle and the protrusion and which upon self-locking connecting releases promptly and thereby an acoustic signal is generated.

According to another aspect of the present disclosure, the actuation paddle comprises a recess, into which the preloaded rib clicks upon self-locking connecting and hits a floor of the recess so that thereby the acoustic signal can be generated.

According to another aspect of the present disclosure, the rib is integrally formed on the protrusion and pivotably arranged on the protrusion, wherein the rib starting from an unpivoted basic position when coupling the protrusion with the actuation paddle is pivotable into a first direction and the rib when decoupling between the protrusion and the actuation paddle is pivotable into a second direction, which is contrary to the first direction.

According to another aspect of the present disclosure, the recess is formed on a rear side of a coupling bar of the actuation paddle. According to another aspect, on an opposite front side of the coupling bar at least one counter click-stop part of the click-stop device is formed as recess.

According to another aspect of the present disclosure, the click-stop connection is configured in such a way that the click-stopped state between the actuation paddle and the protrusion is releasable by drawing the actuation paddle contrary to the coupling direction, in which the actuation paddle is capable of being coupled with the protrusion.

According to another aspect of the present disclosure, the dispenser comprises a guidance comprising a first guiding part, which is arranged on the protrusion and comprising a second guiding part, which is arranged on the actuation paddle, wherein when coupling the protrusion with the actuation paddle the two guiding parts interact so that a relative movement between the protrusion and the actuation paddle is guided. In another aspect, a first guiding part is a guiding side bar and a second guiding part is a guiding groove.

According to another aspect of the present disclosure, the releasable and self-locking connection is configured without additional and separate fixing elements. So in this embodiment the releasable and self-locking connection is configured without further fixing elements, e.g. tools, screws, etc., and can be simply slipped onto and removed from the protrusion by the user himself.

Further features of the present disclosure are apparent from the claims, the figures and the description of figures. The features and feature combinations mentioned above in the description as well as the features and feature combinations mentioned below in the description of figures and/or shown in the figures alone are usable not only in the respectively specified combination, but also in other combinations without departing from the scope of the invention. Thus, implementations are also to be considered as encompassed and disclosed by the invention, which are not explicitly shown in the figures and explained, but arise from and can be generated by separated feature combinations from the explained implementations. Implementations and feature combinations are also to be considered as disclosed, which thus do not comprise all of the features of an originally formulated independent claim. Moreover, implementations and feature combinations are to be considered as disclosed, in particular by the implementations set out above, which extend beyond or deviate from the feature combinations set out in the back-references of the claims.

BRIEF DESCRIPTION OF THE DRAWING FIGURES

Figure 2:
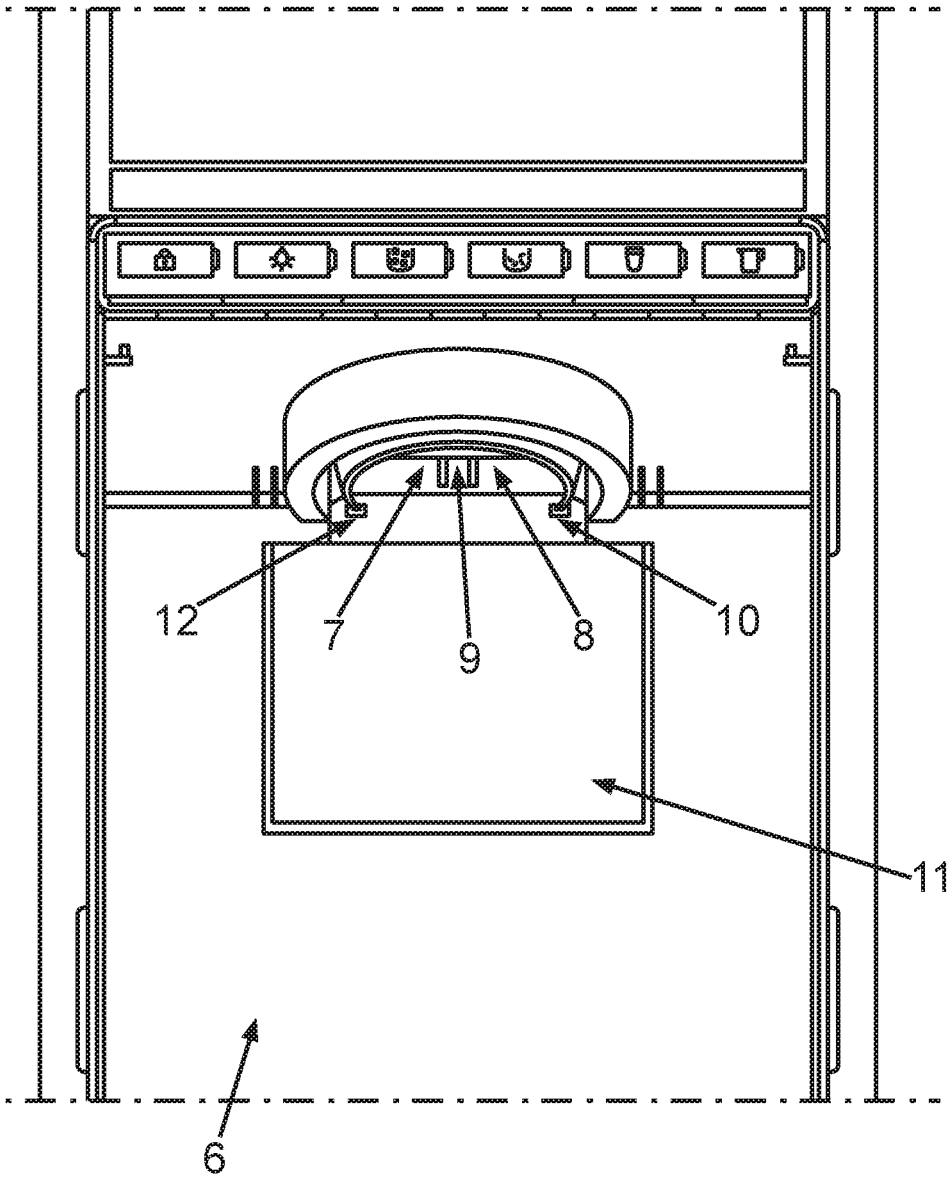
Figure 3:
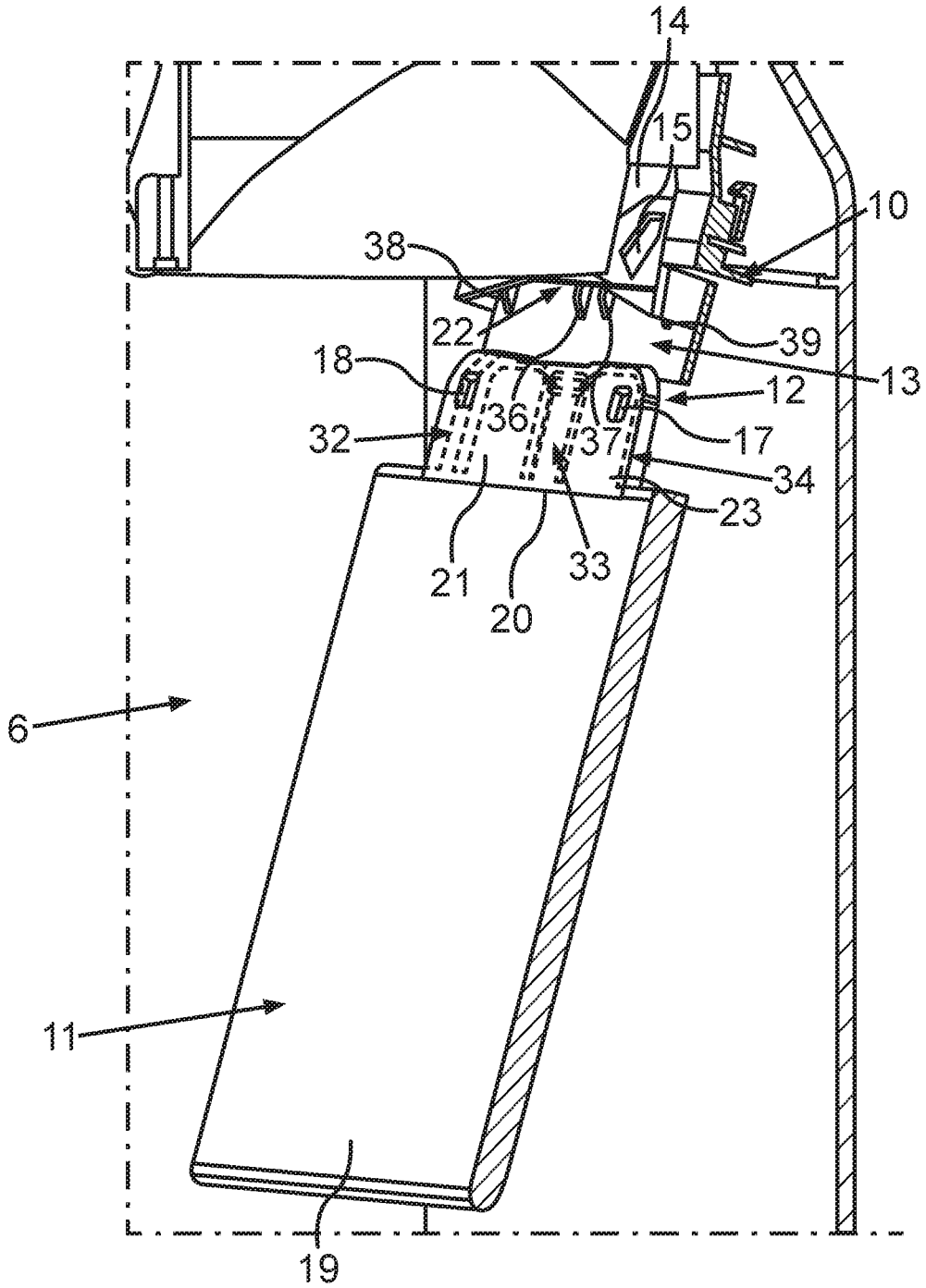
Figure 4:
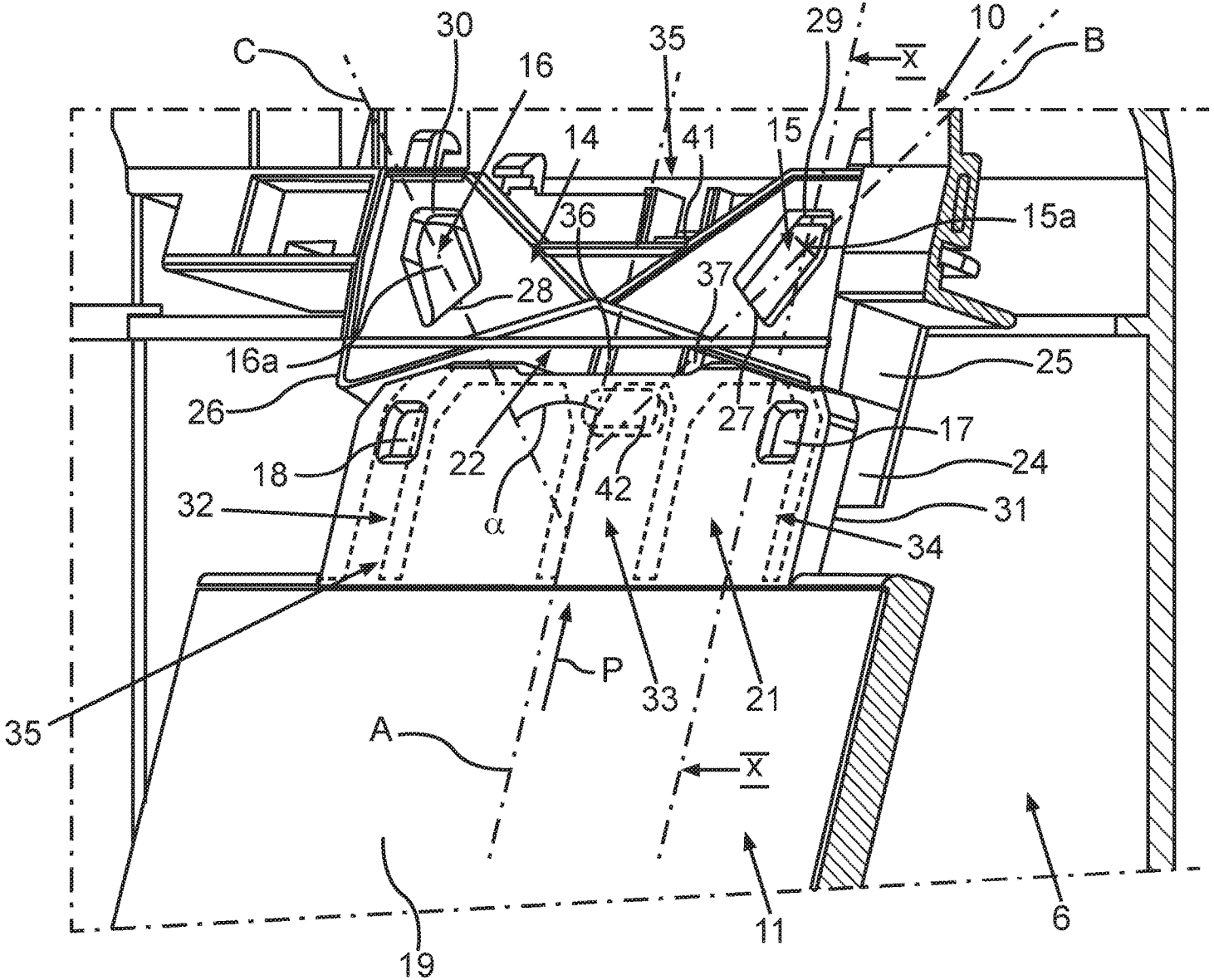
Figure 5:
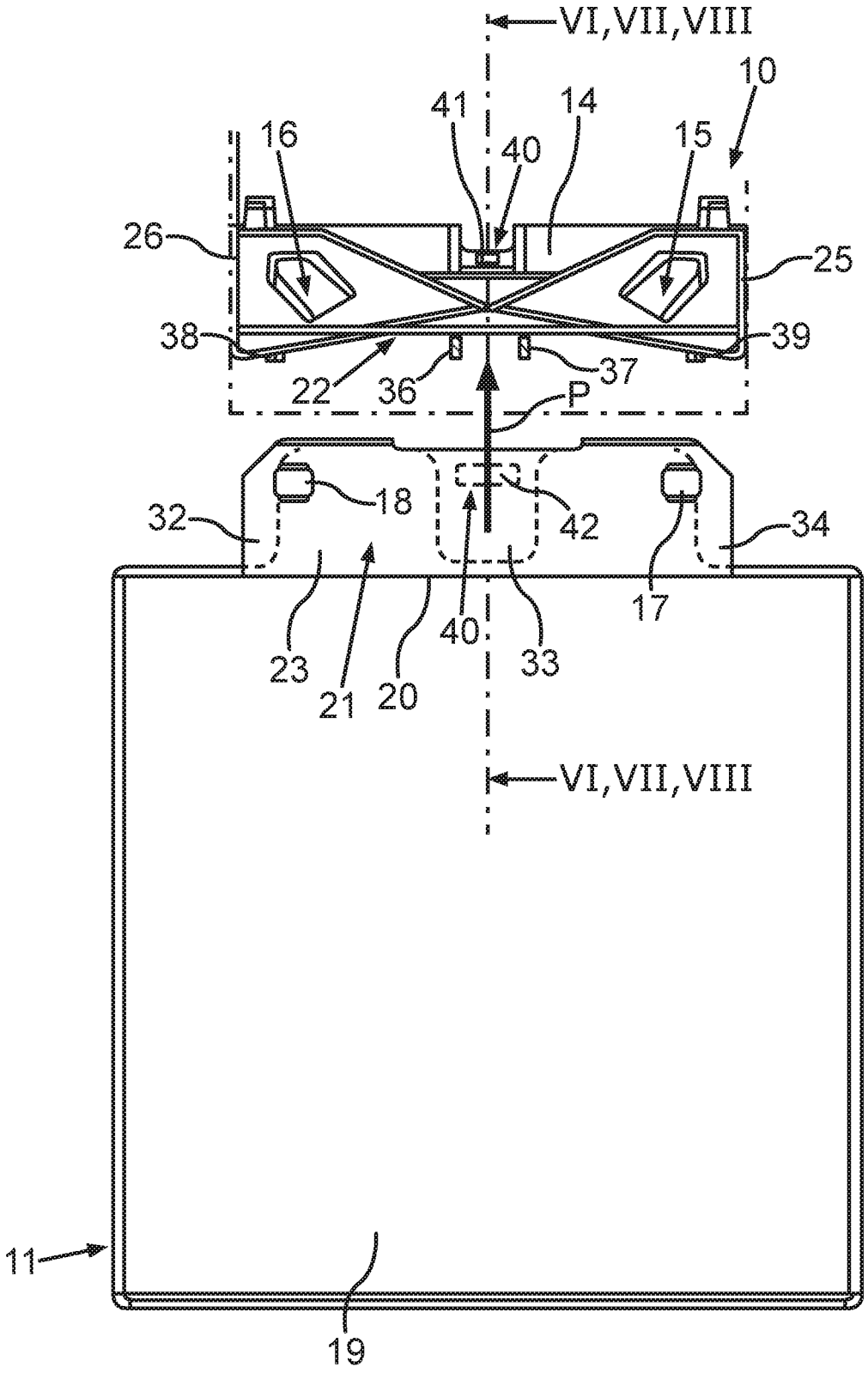
Figure 6:
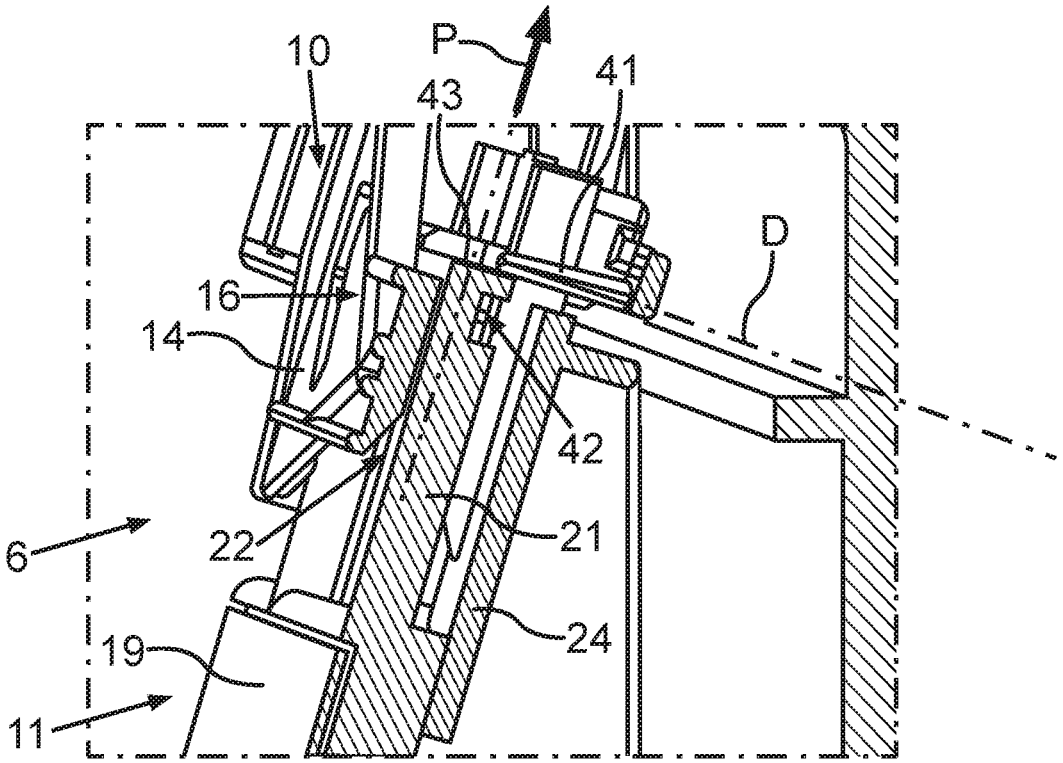
Figure 7:
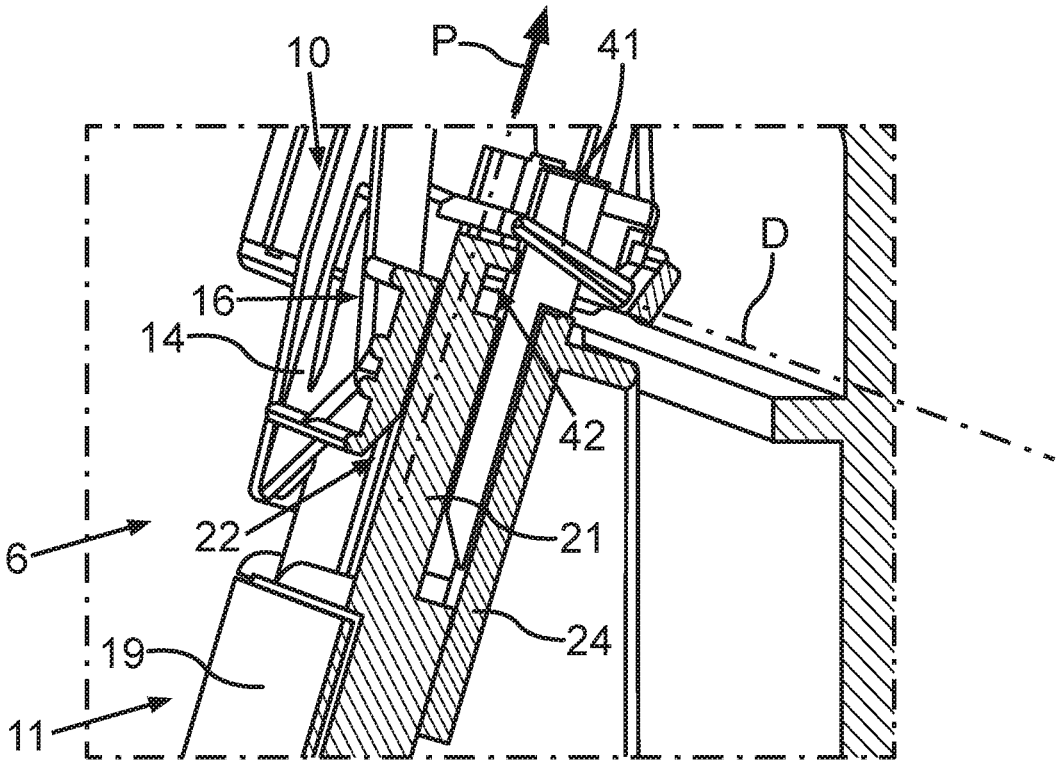
Figure 8:
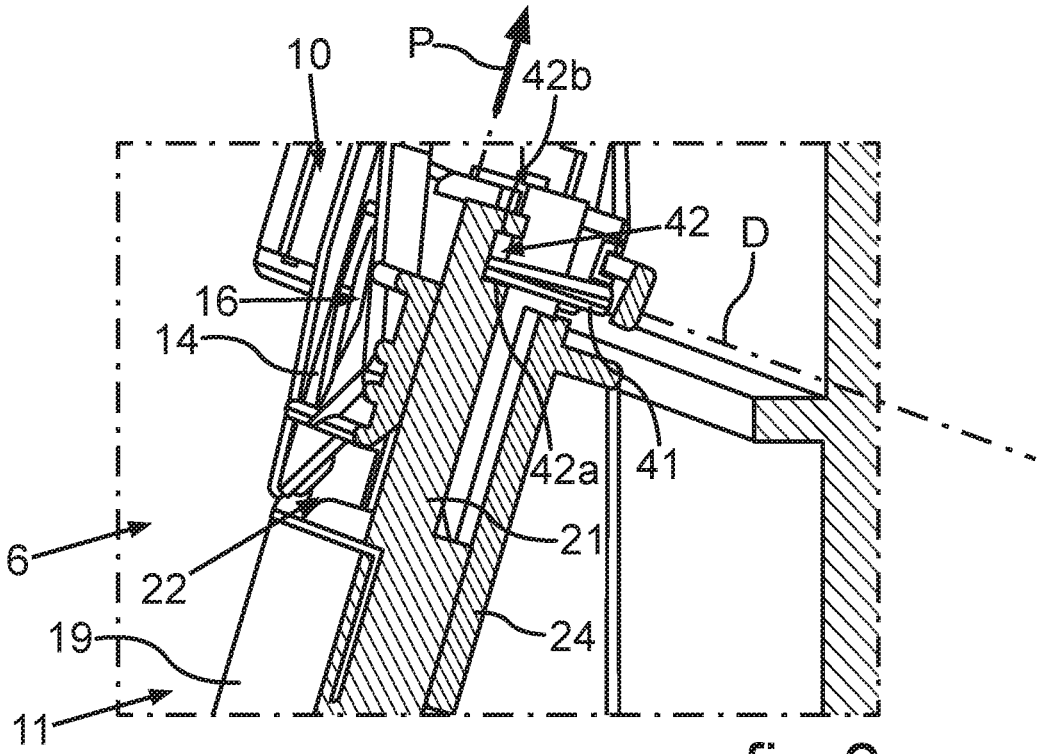
Figure 9:
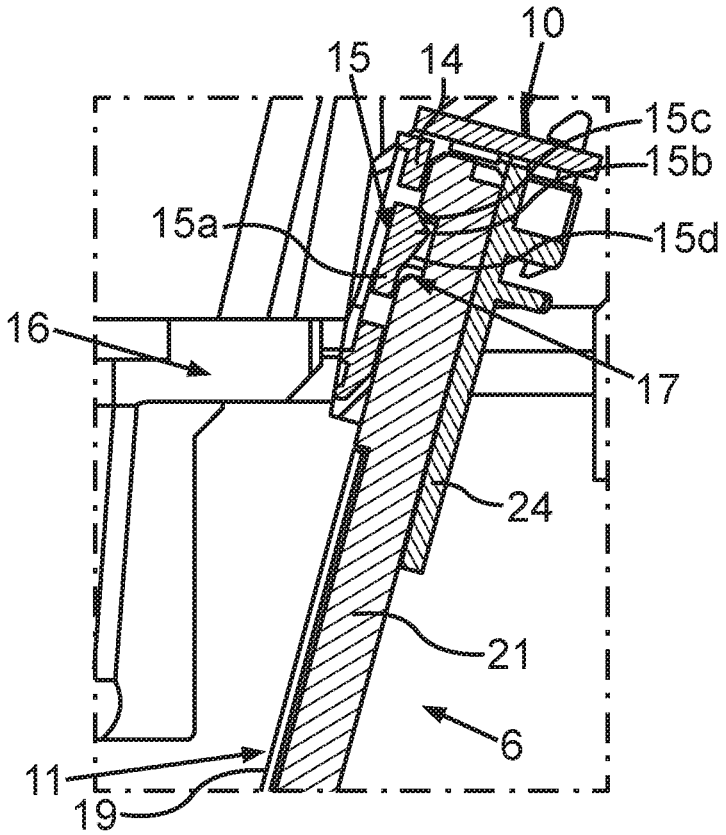
Figure 10:
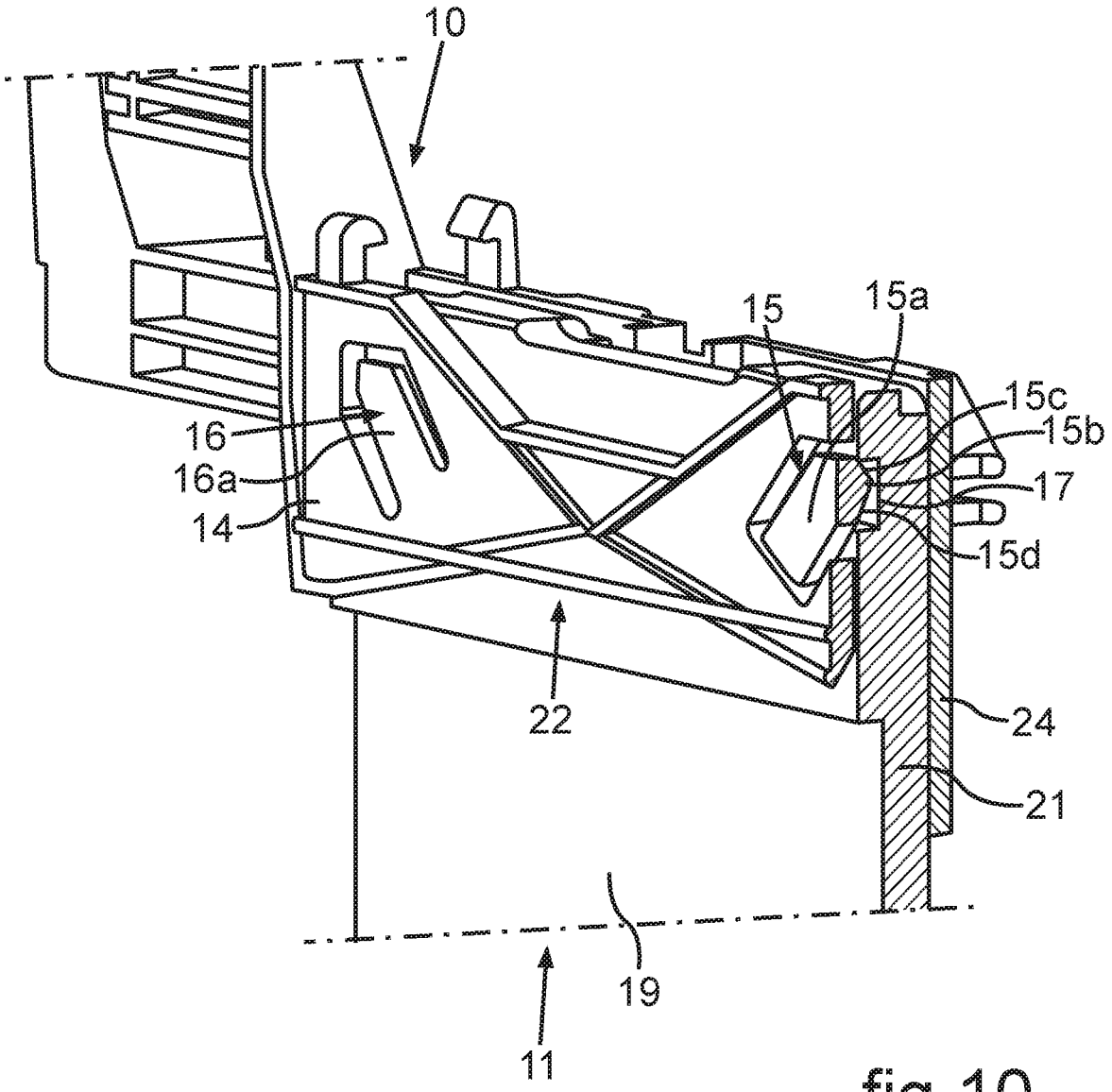
Figure 11:
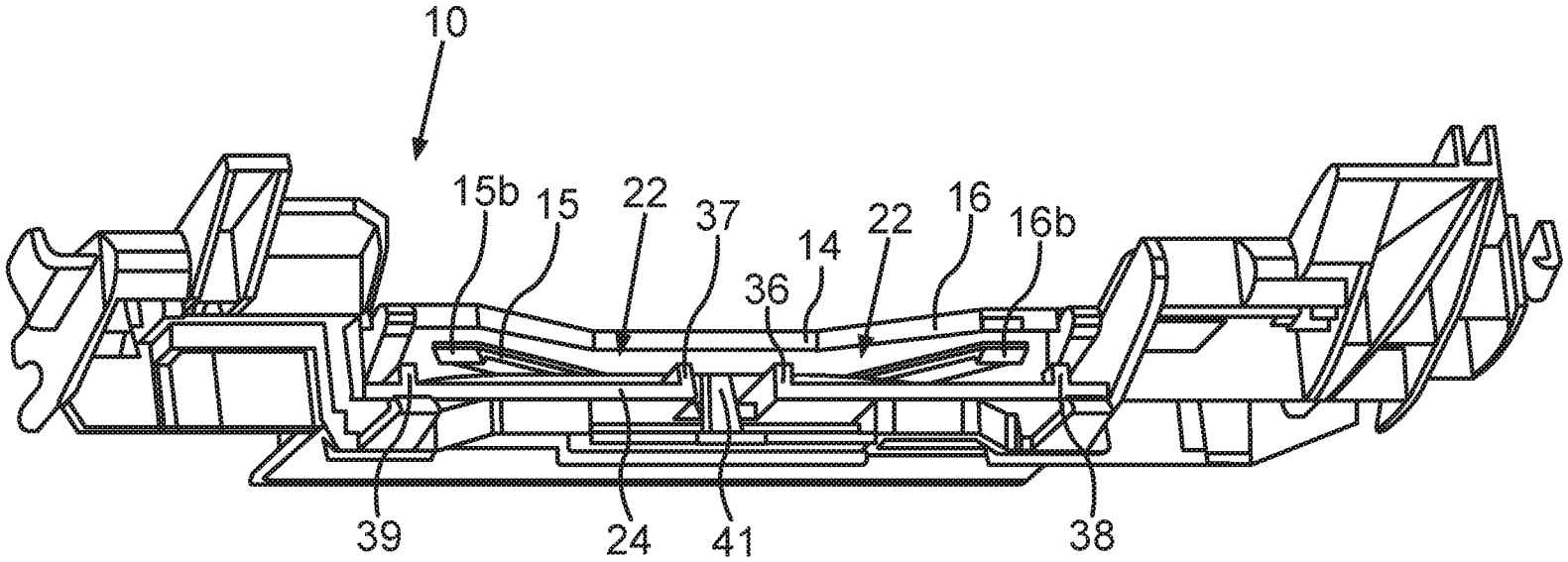
Figure 12:
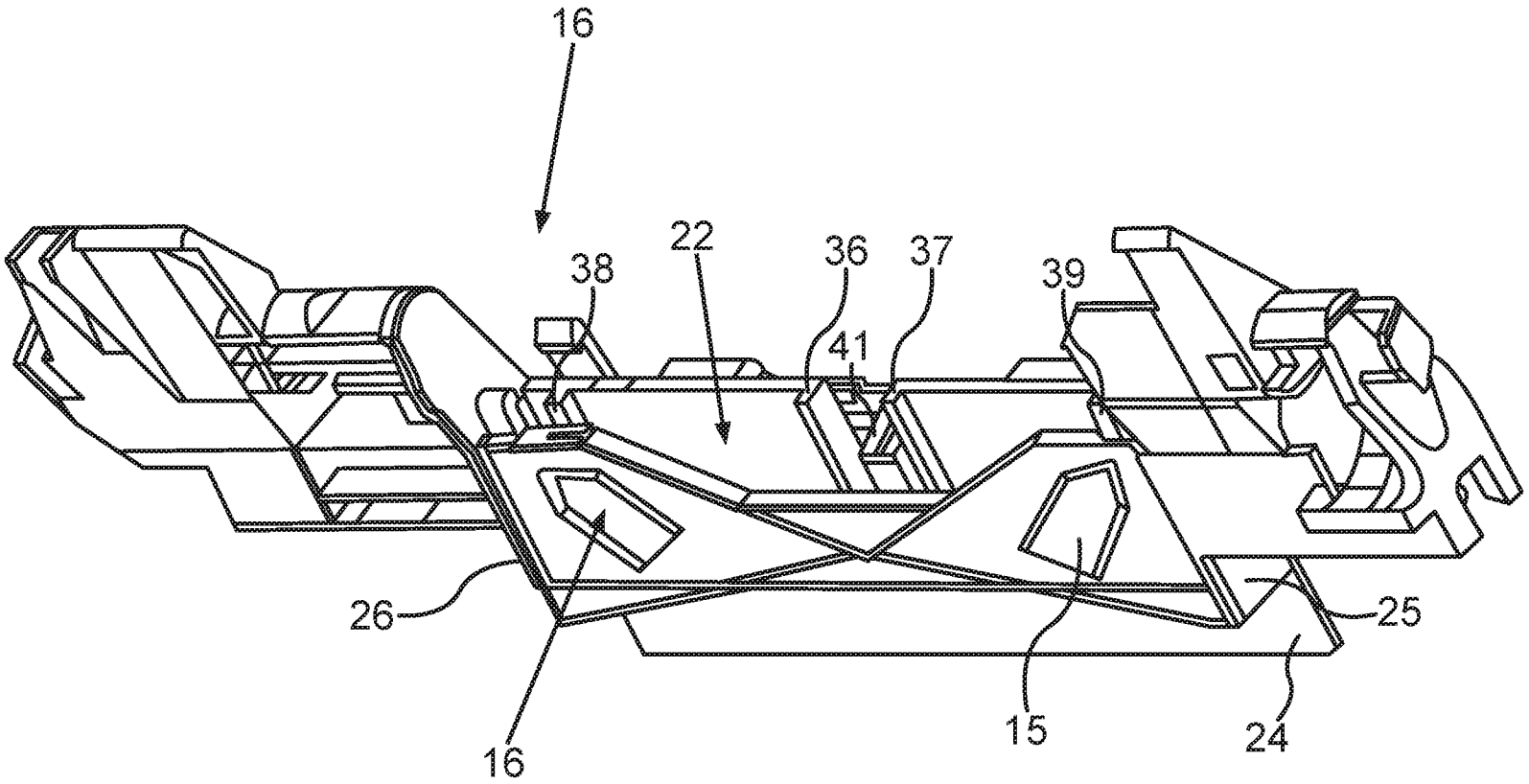

The accompanying drawing figures incorporated in and forming a part of this specification illustrate several aspects of the invention, and together with the description serve to explain the principles of the invention. These show in:

FIG. 1 a simplified perspective view of an embodiment of a household cooling appliance with an embodiment of a dispenser for at least one of ice or liquid;

FIG. 2 an enlarged view of a partial section of the household cooling appliance according to FIG. 1, in which components of the dispenser are shown;

FIG. 3 a perspective view of components of the dispenser in the state, in which the components are separate from each other;

FIG. 4 an enlarged view of partial section of the components according to FIG. 3;

FIG. 5 a further view of the components according to FIG. 4;

FIG. 6 a perspective sectional view of components of the dispenser in a first mounting state;

FIG. 7 a view according to FIG. 6, in which the shown components are shown in a second mounting state that is different therefrom;

FIG. 8 a view according to FIG. 6 and FIG. 7, in which the components are shown in a further third mounting state;

FIG. 9 a sectional view of components, as they are shown in FIG. 6 to FIG. 8, wherein in FIG. 9 the sectional view is shown in a sectional plane that is different therefrom;

FIG. 10 a perspective view of the sectional view in FIG. 9;

FIG. 11 a perspective view of an embodiment of a component, which comprises a protrusion of the dispenser; and FIG. 12 a view of the component according to FIG. 11 in a perspective that is different therefrom.

DETAILED DESCRIPTION OF EXEMPLARY EMBODIMENTS

The exemplary embodiments set forth below represent the necessary information to enable those skilled in the art to practice the invention. Upon reading the following description in light of the accompanying drawing figures, those skilled in the art will understand the concept of the invention and will recognize applications of these concepts not particularly addressed herein. It should be understood that these concepts fall within the scope of the disclosure and the accompanying claims.

Moreover, it should be understood that terms such as top, bottom, front, rearward, upper, lower, upward, downward, and the like used herein are for orientation purposes with respect to the drawings when describing the exemplary embodiments and should not limit the present invention. Also, terms such as substantially, approximately, and about are intended to allow variances to account for manufacturing tolerances, measurement tolerances, or variations from ideal values that would be accepted by those skilled in the art.

With indications of "top", "bottom", "front", "rear", "horizontal", "vertical", "depth direction", "width direction", "height direction", etc., the positions and orientations given in intended use and intended arrangement of the apparatus are specified.

In the figures, identical or functionally identical parts are provided with the same reference signs.

In FIG. 1 in a schematic view a household cooling appliance 1 is shown. The household cooling appliance 1 is a cooling appliance or a refrigeration appliance or a fridge-freezer combination appliance. The household cooling appliance 1 comprises a housing 2. In the housing 2 at least one storage compartment is configured. The storage compartment can be a cooling compartment or a freezer compartment. This storage compartment is bounded by walls of an inner container that is not shown. The inner container is arranged in the housing 2. Between the inner container and an outer container 3 of the housing 2 a thermally insulating material is inserted.

The household cooling appliance 1 moreover shows a door 4, which is shown in FIG. 1 in the closed state. By the door 4 the at least one storage compartment can be closed on the front side.

The household cooling appliance 1 moreover comprises a dispenser 5 for ice and/or water, hereinafter named as ice-liquid dispenser 5. The ice-liquid dispenser 5 is arranged with at least partial components in the door 4. It comprises an output niche 6. The output niche 6 is open and accessible on the front side. Into the output niche 6 a receiving container, such as for instance a drinking glass or the like can be inserted. In this output niche 6 ice and/or liquid is output. The ice-liquid dispenser 5 comprises an ice passage 7 (FIG. 2) and/or a liquid outlet 8 (FIG. 2).

With the ice-liquid dispenser 5 water can be output, which for instance is guided through an external water network to the household cooling appliance 1. In particular this water is cooled in the ice-liquid dispenser 5. The ice-liquid dispenser 5 preferably also comprises an ice maker. This is configured to make formed ice elements from the supplied water, such as for instance ice cubes or crushed ice. In particular this water is cooled in the ice-liquid dispenser 5. The water in this connection is frozen in the ice maker. For this purpose the ice maker comprises an ice-forming bowl, into which the water can be introduced and frozen therein. The formed ice elements produced in this way can thus be released from the ice-forming bowl and be collected in a collection container of the ice maker. When the output of such formed ice elements is desired and activated, these can then be conveyed out from this collection container through a conveyor device, for instance a screw-conveyor or a spiral conveyor, and be brought to the ice passage 7. From there they then reach the output niche 6 and drop into the provided receiving vessel.

Moreover the ice-liquid dispenser 5 comprises a switch 9 (FIG. 2), which activates an output of ice and/or liquid from the ice-liquid output dispenser 5. The switch 9 comprises a protrusion 10, as is shown in FIG. 2 in partial representation. Moreover the ice-liquid dispenser 5 comprises an actuation paddle 11. The actuation paddle 11 is a part that is separate from the protrusion 10. The actuation paddle 11 is non-destructively releasably attached to the protrusion 10. At least the actuation paddle 11 extends into the output niche 6 in order to be actuated by an object held into the output niche 6. This object may for instance be the drinking vessel.

Moreover the actuation paddle 11 can also be actuated directly by a user, for instance if he touches the actuation paddle with a finger and presses it towards the back.

The actuation paddle 11 is connected to a releasable, self-locking connection 12 with the protrusion 10.

In a perspective sectional view in FIG. 3 the actuation paddle 11 and the protrusion 10 are shown. The actuation paddle 11 is shown in a state, in which it is separate from the protrusion 10 and thus decoupled from it.

The releasable, self-locking connection 12 can be a click-stop connection 13. The click-stop connection 13 can be a snap-fit connection.

Generally viewed, this click-stop connection 13 comprises at least one click-stop part, which can be arranged on the actuation paddle 11 or on the protrusion 10. Moreover the click-stop connection 13 for this purpose comprises a counter click-stop part, which is separate therefrom and which is arranged on the other part and thus on the protrusion 10 or the actuation paddle 11.

In the embodiment shown in FIG. 3 it is envisaged that the protrusion 10 comprises at least one protrusion wall 14. In this protrusion wall 14 at least one click-stop part 15 formed. In an embodiment according to the view in FIG. 4 two separate click-stop parts 15 and 16 are formed in this protrusion wall 14. The click-stop parts 15 and 16 are integrally formed with the protrusion wall 14.

In particular in the embodiment shown in FIG. 3 at least one counter click-stop part 17 is configured in the actuation paddle 11. In an advantageous embodiment two separate counter click-stop parts 17 and 18 are configured in the actuation paddle 11.

In the shown embodiment the actuation paddle 11 comprises an actuation plate 19. On this actuation plate 19 a coupling bar 21 is formed on a top edge 20. This coupling bar 21 extends from this edge 20 upward and is configured as plate-like strip. In particular the actuation paddle 11 is configured as a single piece. This coupling bar 21 in the width direction (x direction) is configured to be more narrow than the actuation plate 19. This coupling bar 21 is envisaged for coupling mechanically directly with the protrusion 10. In the shown embodiment the protrusion 10 is configured to comprise a shaft 22. The shaft 22 is a receiving shaft for the coupling bar 21. This shaft 22 is open towards the bottom so that the actuation paddle 11 with the coupling bar 21 coming from below can be inserted into this shaft 22. For the mechanical connection of the actuation paddle 11 and the protrusion 10 thus the introducing or inserting of the actuation paddle 11, in particular the coupling bar 21, into the protrusion 10, in particular its shaft 22 is performed. In addition to this inserting then the mechanical connection is formed by the releasable and self-locking connection 12. Thus, in addition to a slipping or inserting of the actuation paddle 11 and the protrusion 10 into each other a defined further mechanical coupling is provided, namely by the releasable and self-locking connection 12.

As can be seen in FIG. 3, the two counter click-stop parts 17 and 18 are configured as a single-piece in the coupling bar 21. In particular they are integrated in a front side 23 of the coupling bar 21. The counter click-stop parts 17 and 18 are configured as depressions or indentations.

In a further embodiment it can be envisaged that the number of the counter click-stop parts 17 and 18 is more than two. In particular then also the click-stop parts 15 and 16 are provided in a corresponding number. In a further embodiment it can be envisaged that the counter click-stop parts 17 and 18 are configured in the protrusion 10 and the click-stop parts 15 and 16 are configured in the actuation paddle 11. In a further embodiment it may be envisaged that the shaft 22 is formed on the actuation paddle 11, in particular on the top edge 20 and is configured to be open towards the top and a coupling bar 21 is formed on the protrusion 10. In such embodiment the mechanical coupling corresponds to that shown in FIG. 3, however, the named components are exchanged, and the components formed in FIG. 3 on the protrusion 10 then are arranged on the actuation paddle 11 and vice versa.

In FIG. 4 in an enlarged view a partial section of the components of FIG. 3 is shown. Moreover the actuation paddle 11 is already brought closer towards the protrusion 10. In FIG. 4 moreover an arrow is shown, which represents the coupling direction P between the actuation paddle 11 and the protrusion 10. This coupling direction P is orientated in a straight line. Moreover in FIG. 4 a longitudinal axis A, the longitudinal axis of the actuation paddle 11, and the protrusion 10 are shown.

In the embodiment in FIG. 3 and FIG. 4 it is envisaged that both the two click-stop parts 15 and 16 as well as also the two counter click-stop parts 17 and 18 are configured to be symmetrical to this longitudinal axis A. It can also be seen that the click-stop parts 15 and 16 each comprise a base plate 15*a* and 16*a* with their surface shapes. These base plates 15*a* and 16*a* extend in the plane, in which the protrusion wall 14 extends. The protrusion wall 14 is a front wall bounding the shaft 22. Moreover also a rear wall 24 and side walls 25 and 26 are provided as further protrusion walls, which moreover bound the shaft 22. The click-stop parts 15 and 16 are configured to be resilient in the protrusion wall 14. For this purpose these click-stop parts 15 and 16, in particular the base plates 15*a* and 16*a* are connected in the linkage points 27 and 28 integrally formed with the protrusion wall 14. Otherwise the base plates 15*a* and 16*a* are configured not to touch the protrusion wall 14. In this regard in the protrusion wall 14 recesses 29 and 30 are formed, which receive the base plates 15*a* and 16*a* and in an embodiment comprise a corresponding inner contour corresponding to the outer contour of the base plates 15*a* and 16*a*.

As can be recognized, the base plates 15*a* and 16*a* have longitudinal axes B and C. These longitudinal axes B and C extend in the plane of the base plates 15*a*, 16*a* and are orientated at an angle $\alpha$ to the longitudinal axis A. This angle $\alpha$ preferably amounts to between 30° and 70°, preferably between 30° and 60°.

This inclined or tilted orientation of the click-stop parts 15 and 16, in particular their base plates 15*a* and 16*a* is advantageous in order to achieve a preferred spring effect of these click-stop parts 15 and 16. In particular this is then facilitated if these base plates 15*a* and 16*a* viewed along their longitudinal axes B and C have a corresponding length in comparison with their widths formed in the linkage points 27 and 28. In order to ensure a compact design of the entire arrangement, it is advantageous, if the protrusion wall 14, viewed in the direction of the longitudinal axis A, if possible, has a low height, on the other hand, though, is designed in such a way that it also achieves a desired mechanical stability. In the embodiment shown here due to the geometry and design of the protrusion wall 14 an arrangement of the base plates 15*a* and 16*a* in this tilted position relative to the longitudinal axis A is formed. Thereby the preferred length of these base plates 15*a* and 16*a* in the direction of the longitudinal axes B and C can be realized. If the protrusion wall 14, viewed in the longitudinal axis A, in this central portion, which tapers towards the top, is configured to be higher, in a further embodiment the arrangement of the click-stop parts 15 and 16 can also be effected in such a way that the longitudinal axes B and C extend in parallel relative to the longitudinal axis A.

As can be recognized, the counter click-stop parts 17 and 18 towards the front and thus in the inserted state of the coupling bar 21 into the shaft 22 are configured to be open towards the protrusion wall 14.

Thus the click-stop noses of these click-stop parts 15 and 16, which cannot yet be recognized, can perform click-stop engagement with these counter click-stop parts 17 and 18. The click-stop noses are facing the shaft 22.

In this connection already at this point reference is made to FIG. 9 and FIG. 10. There a sectional view along the sectional line X-X is shown in FIG. 4. There the click-stop part 15 can be seen in a sectional view. The base plate 15*a* is equally shown, as is the already mentioned click-stop nose 15*b*. The click-stop part 15 is configured as a single piece. As can be discerned in FIG. 9 and FIG. 10, this click-stop nose 15*b* has a bump-like geometry. In particular a top bounding wall 15*c* is configured to be tilted or configured as chamfered edge. A further, viewed in the height direction (y direction), bottom bounding wall 15*d* is equally inclined and thus forms a chamfered edge. The two bounding walls 15*c* and 15*d* extend in such a way relative to each other that the click-stop nose 15*b* is configured to be tapered. By such design of the click-stop nose 15*b* thus a continuous and jerk-free and clamp-free click-stop engagement of the click-stop nose 15*b* with the counter click-stop part 17 is facilitated. Equally it is then also facilitated that the non-destructively releasable disengaging between the actuation paddle 11 and the protrusion 10 can be achieved in analogy. The disengaging can be achieved by a simple pulling of the actuation paddle 11 contrary to the coupling direction P. The clicked-stopped state between the click-stop parts 15 and 16, on the one hand, and the counter click-stop parts 17 and 18, on the other hand, can then be released.

In another embodiment the disengaging between the actuation paddle 11 and the protrusion 10 can be achieved by pressing a fastener button. When pressing said fastener button, which can be a resilient plate, especially with a finger, the engaging can be released and the actuation paddle 11 can be pulled of the protrusion 10.

In FIG. 10 the perspective view of the sectional view in FIG. 9 is shown. The mounted end state of the actuation paddle 11 on the protrusion 10 is shown. Moreover in FIG. 4 it can be recognized that in a rear side 31 of the coupling bar 21 guiding parts 32, 33, and 34 are configured. The guiding parts 32 to 34 are configured here as guiding recesses or guiding grooves. They are integral part of a guidance 35. By the guidance 35 the mechanical coupling is guided between the actuation paddle 11 and the protrusion 10. In particular in this connection the linear relative movement between the actuation paddle 11 and the protrusion 10 is guided in the direction of the coupling direction P as well as when decoupling contrary to this coupling direction P. By this guidance 35 thus a clamping or strutting or tilting in particular of the actuation paddle 11 is avoided, if same is introduced or inserted into the protrusion 10, so that this introducing or inserting is effected in a straight line. Thereby the click-stop engagement can be achieved accurately and fast.

The guidance 35 moreover comprises second guiding parts 36 and 37 as well as 38 and 39 (FIG. 3 and FIG. 5). In an advantageous embodiment these second guidance parts 36 to 39 are configured as guiding bars. When mechanically coupling between the actuation paddle 11 and the protrusion 10, these two guiding parts 36 to 39 engage with the first guiding parts 32, 33, and 34.

The second guiding parts 38 to 39 are integrally formed on an inner side of the rear wall 24, which represents a further protrusion wall of the protrusion 10. This inner side faces the shaft 22.

As can already be discerned in FIG. 3 and FIG. 4, the base plates 15*a* and 16*a* extend in the plane, in which the protrusion wall 14 extends.

Moreover, the ice-liquid dispenser 5 comprises an acoustic signaling device 40. This can be discerned in FIG. 5. This acoustic signaling device 40 comprises a rib 41, which in the embodiment is integrally formed with the protrusion 10. This rib 41 extends from the rear protrusion wall 24 into the shaft 22. This rib 41 thus is orientated in the depth direction (z direction) towards the front.

Moreover, the acoustic signaling device 40 comprises a recess 42. The recess 42 in the embodiment is configured as actuation paddle 11. In particular this recess 42 is configured as depression or indentation. The recess 42 in the embodiment is configured on the rear side 31 of the coupling bar 21.

The recess 42 can also be discerned in FIG. 3 and FIG. 4. The rib 41 is also shown in FIG. 4.

As can be seen, the rib 41 is preferably formed in the width direction (x direction) centrally in the middle of the shaft 22. In particular also the recess 42 is arranged in the middle in this regard. Preferably, viewed in this width direction, the two counter click-stop devices 17 and 18 are arranged on opposite sides to the recess 42. In particular the recess 42 in the same way as the counter click-stop parts 17 and 18 is not a through-hole, but rather is configured as a blind hole and thus only open towards the back viewed in the depth direction. The opening of this recess 42 thus is formed only in the direction of the rear protrusion wall 24.

In FIGS. 6 to 8 various mounting states between the actuation paddle 11 and the protrusion 10 are shown. In FIGS. 6 to 8 perspective sectional views along the section lines VI-VI, VII-VII, and VIII-VIII in FIG. 5 are shown. Thus views of sections through the rib 41, on the one hand, and through the recess 42, on the other hand, are provided. In FIG. 6 in this connection a mounting state is shown, in which the actuation paddle 11 is already partially inserted into the shaft 22, however, neither the click-stopped state is achieved nor the acoustic signaling device 40 activated. As can be seen in this connection, the rib 41 viewed in the depth direction extends towards the front into the shaft 22, and this by such a length that it protrudes into the movement path of the actuation paddle 11 represented by the arrow P.

In FIG. 6 a state is shown, in which a top edge 43 of the coupling bar 21 has just reached the rib 41 from below, however, has not yet actuated it from its unpivoted basic position shown in FIG. 6. This rib 41 is integrally formed with the protrusion 10, however is arranged thereon to be pivotable in a defined way.

Starting from the representation in FIG. 6 upon a further insertion of the coupling bar 21 into the shaft 22 according to the representation in FIG. 7 the rib 41 is moved out of its basic position. In this regard according to the representation in FIG. 7 it is pivoted about a pivoting axis D, which is orientated horizontally and thus in the width direction (x-direction). The rib 41 thus is pivoted in a first direction about the pivot axis D or rotational axis upward. If then according to the representation in FIG. 8 starting from this state, in which also the click-stopped state between the actuation paddle 11 and the protrusion 10 has not been reached, the actuation paddle 11 is further inserted in the direction of the arrow P into the shaft 22, the rib 41 then suddenly snap-fits into the recess 42, and hits a bottom 42*a* of this recess 42. Due to this abrupt snap-fitting of the rib 41 into the recess 42 and by the rib 41 hitting the floor 42*a* a defined acoustic noise is produced. Thereby the mounted end state of the actuated paddle 11 on the protrusion 10 is acoustically indicated. When this rib 41 then snap-fits into the recess 42, the clicked-stopped state of the releasable self-locking connection 12 is achieved. In particular in this connection the click-stopped state between the click-stop parts 15 and 16 and the counter click-stop parts 17 and 18 is reached.

If the actuation paddle 11 is released from the protrusion 10, contrary to the coupling direction P of the actuation paddle 11 is pulled down. In doing so not only the click-stopped state between the click-stop parts 15 and 16 and the counter click-stop parts 17 and 18 is released, but also the release of the rib 41 from the recess 42 is automatically achieved. The rib 41 in this regard is elastically deformable in such a way that it then hits a ceiling 42*b* of the recess 42, upon pulling the actuation paddle 11 further down is deformed in this regard and is bent down. In particular therein the rib 41 is pivoted about the pivot axis D downward and thus contrary to the direction, in which it is pivoted upward starting from FIG. 6 towards FIG. 7. In FIG. 11 in a perspective view the protrusion 10 is shown as component. In particular the protrusion 10 is an integrally formed component made of plastics. Both the rib 41 as well as the click-stop parts 15 and 16 with their click-stop noses 15*b* and 16*b*, which are configured to be tapered, can be discerned.

In FIG. 12 the protrusion 10 is shown in a perspective that is different from FIG. 11.

LIST OF REFERENCE CHARACTERS

1 household cooling appliance
2 housing
3 outer container
4 door
5 dispenser
6 output niche
7 ice passage
8 liquid outlet
9 switch
10 protrusion
11 actuation paddle
12 connection
13 click-stop connection
14 protrusion wall
15 click-stop part
15*a* base plate
15*b* click-stop nose
15*c* bounding wall
15*d* bounding wall
16 click-stop part
16*a* base plate
16*b* click-stop nose
16*c* bounding wall
16*d* bounding wall
17 counter click-stop part
18 counter click-stop part
19 actuation plate
20 edge
21 coupling bar
22 shaft
23 front side
24 rear wall
25 sidewall
26 sidewall
27 linkage point
28 linkage point
29 recess
30 recess
31 rear side

32 guiding part
33 guiding part
34 guiding part
35 guidance
36 guiding part
37 guiding part
38 guiding part
39 guiding part
40 signaling device
41 rib
42 recess
42*a* bottom
42*b* ceiling
43 edge

The invention claimed is:

1. A dispenser for dispensing at least one of ice or liquid and for mounting into a household cooling appliance, the dispenser comprising:

an output niche, at least one of an ice passage or liquid outlet, a switch activating an output of at least one of ice or liquid out of the dispenser, the switch including a protrusion having at least one protrusion wall (14), a separate actuation paddle attached to the protrusion, the actuation paddle projecting into the output niche in order to be pressed by an object held into the output niche, and a releasable and self-locking connection interconnecting the actuation paddle and the protrusion, the releasable and self-locking connection being a click-stop connection, the click-stop connection including at least one click-stop part and the click-stop part being integrally formed with the protrusion wall and resiliently arranged on the protrusion wall.

2. The dispenser according to claim 1, wherein the click-stop part comprises a base plate extending with its surface shape in the plane of the protrusion wall and is resiliently arranged on the protrusion wall.

3. The dispenser (5) according to claim 2, wherein the click-stop part comprises a click-stop nose, and the click-stop nose is integrally formed with the base plate, wherein the click-stop nose is configured for click-stop engagement with a counter click-stop part configured on the actuation paddle.

4. The dispenser according to claim 3, wherein the click-stop nose is configured to be tapered.

5. The dispenser according to claim 4, wherein the tapering comprises at least two inclined walls, which are tapered to each other.

6. The dispenser according to claim 2, wherein the base plate has a longitudinal axis extending in the plane of the base plate and through a linkage point of the base plate to the protrusion wall, wherein the longitudinal axis is orientated at an angle of between 30° and 70° relative to a linear coupling direction, in which the actuation paddle is coupled to the protrusion.

7. The dispenser according to claim 1, wherein the click-stop connection comprises at least two click-stop parts and at least two counter click-stop parts for click-stop engagement of the actuation paddle with the protrusion.

8. The dispenser according to claim 1, wherein the click-stop connection is configured in such a way that the click-stopped state between the actuation paddle and the protrusion is releasable by drawing the actuation paddle contrary to the coupling direction, in which the actuation paddle is capable of being coupled with the protrusion.

9. The dispenser according to claim 1, wherein the releasable and self-locking connection is configured without additional and separate fixing elements.

10. A dispenser for dispensing at least one of ice or liquid and for mounting into a household cooling appliance, the dispenser comprising:

an output niche, at least one of an ice passage or liquid outlet, a switch activating an output of at least one of ice or liquid out of the dispenser, the switch including a protrusion, the protrusion including a receiving shaft bounded by protrusion walls of the protrusion, a separate actuation paddle attached to the protrusion, the actuation paddle projecting into the output niche in order to be pressed by an object held into the output niche, the actuation paddle including a coupling bar, and the actuation paddle in the clicked-in end state of the actuation paddle with the protrusion being introduced with said coupling bar into the receiving shaft, and a releasable and self-locking connection interconnecting the actuation paddle and the protrusion, the releasable and self-locking connection being a click-stop connection.

11. A dispenser for dispensing at least one of ice or liquid and for mounting into a household cooling appliance, the dispenser comprising:

an output niche, at least one of an ice passage or liquid outlet, a switch activating an output of at least one of ice or liquid out of the dispenser, the switch including a protrusion with a click-stop part, a separate actuation paddle attached to the protrusion, the actuation paddle projecting into the output niche in order to be pressed by an object held into the output niche, the actuation paddle including a coupling bar, in which a counter click-stop part is integrally formed and configured for click-stop engagement with the click-stop part formed on the protrusion, and a releasable and self-locking connection interconnecting the actuation paddle and the protrusion, the releasable and self-locking connection being a click-stop connection.

12. A dispenser for dispensing at least one of ice or liquid and for mounting into a household cooling appliance, the dispenser comprising:

an output niche, at least one of an ice passage or liquid outlet, a switch activating an output of at least one of ice or liquid out of the dispenser, the switch including a protrusion, a separate actuation paddle attached to the protrusion, the actuation paddle projecting into the output niche in order to be pressed by an object held into the output niche, a releasable and self-locking connection interconnecting the actuation paddle and the protrusion, the releasable and self-locking connection being a click-stop connection, and an acoustic signaling device, by which the click-stopped state is acoustically signaled.

13. The dispenser according to claim 12, wherein the acoustic signaling device comprises an elastic rib, which is elastically preloaded when coupling between the actuation paddle and the protrusion and which upon self-locking connecting releases promptly and thereby an acoustic signal is generated.

14. The dispenser according to claim 13, wherein the actuation paddle comprises a recess snaps in upon self-locking connecting and hits a floor of the recess so that thereby the acoustic signal can be generated.

15. The dispenser according to claim 13, wherein the rib is integrally formed with the protrusion and pivotably arranged on the protrusion, wherein the rib starting from an unpivoted basic position when coupling the protrusion with the actuation paddle is pivotable into a first direction and the rib when decoupling between the protrusion and the actuation paddle is pivotable into a second direction, which is contrary to the first direction.

16. A dispenser for dispensing at least one of ice or liquid and for mounting into a household cooling appliance, the dispenser comprising:

an output niche, at least one of an ice passage or liquid outlet, a switch activating an output of at least one of ice or liquid out of the dispenser, the switch including a protrusion, a separate actuation paddle attached to the protrusion, the actuation paddle projecting into the output niche in order to be pressed by an object held into the output niche, a releasable and self-locking connection interconnecting the actuation paddle and the protrusion, the releasable and self-locking connection being a click-stop connection, and a guidance including at least one first guiding part arranged on the protrusion and comprising at least one second guiding part arranged on the actuation paddle, wherein when coupling the protrusion with the actuation paddle the two guiding parts interacting for guiding a relative movement between the protrusion and the actuation paddle.

* * * * *